US005957650A

United States Patent [19]

Rollo

[11] Patent Number: 5,957,650

[45] Date of Patent: Sep. 28, 1999

[54] GRAPPLING DEVICE FOR A MATERIAL HANDLING APPARATUS

[76] Inventor: James Scott Rollo, 3507 S. Shore, Humble, Tex. 77338

[21] Appl. No.: 08/926,144

[22] Filed: Sep. 9, 1997

[51] Int. Cl.[6] ..... E02F 3/00

[52] U.S. Cl. ..... 414/724; 37/406; 37/903; 414/912

[58] Field of Search ..... 414/724, 729, 414/912; 37/403, 405, 406, 903

[56] References Cited

U.S. PATENT DOCUMENTS

| | | | |
|---|---|---|---|
| 4,155,473 | 5/1979 | Holopainen | 414/704 |
| 4,283,866 | 8/1981 | Ogawa | 37/117.5 |
| 4,375,345 | 3/1983 | Hanson | 414/722 |
| 4,403,906 | 9/1983 | Holopainen | 414/724 |
| 4,519,739 | 5/1985 | Risch | 414/724 |
| 4,669,947 | 6/1987 | Frost | 414/724 |
| 5,111,602 | 5/1992 | Risch | 37/117.5 |
| 5,544,435 | 8/1996 | Somero | 37/403 X |

*Primary Examiner*—Donald W. Underwood
*Attorney, Agent, or Firm*—Fulbright & Jaworski L.L.P.

[57] ABSTRACT

An improved grappling device for a material handling apparatus, including one or more fingers which may be mounted on the material handling apparatus. The fingers are storable to a non-use position on the rear side of the bucket of a material handling apparatus and retractable to an operating position in front of the bucket of a material handling apparatus by means of hydraulic power. When in use, the fingers cooperates with the material handling apparatus and enables an operator to manipulate a wider range of loads.

12 Claims, 4 Drawing Sheets

GRAPPLING DEVICE FOR A MATERIAL HANDLING APPARATUS

BACKGROUND OF THE INVENTION

This invention relates to a grappling device for a material handling apparatus and improvements of the same. More specifically, this invention relates to an extendable and retractable grappling device on a material handling apparatus which expands the useful operation thereof.

In construction and agricultural operations, it is common practice to use an apparatus known as a "front-end loader" or a "bucket loader", which consists of a large bucket mounted and extending transversely on the front of a tractor. The bucket is used to transfer dirt, stones and loose material. While front-end loaders have a wide range of functions in connection with material handling, their use is nevertheless limited.

For example, operators often confront the need to pickup brush, logs, round hay bales and like objects which do not fit or remain balanced within the bucket holding area. Various art forms attempt to address shortcomings in front-end loaders. For example, the John-Deer Bale and Silage Grapple, the Kubota Grapple Bucket and the Massey Ferguson Grapple Forks permanently attach a grappling device to a front-end loader bucket. A grappling device works in cooperation with a bucket loader and holds awkward loads within the bucket.

While such grappling arm designs allow for the handling of a wider range of material, the grappling arms create both a physical and a visual obstruction to the normal operation of the loader bucket. In a non-use position, the grappling device interferes with an operator's sight. Further, in both a non-use and use position, the grappling device is subject to damage by abnormal forces and loads.

In order to overcome such obstructions, storable devices which mount on the bucket of a front-end loader have been suggested. For example, U.S. Pat. Nos. 4,403,906 and 4,155,473 disclose front-end loaders comprising a clamp arm attached to the bucket of a material handling apparatus. Similarly, U.S. Pat. No. 4,669,947 discloses a front-end loader which includes a loading fork mounted on a bucket, which may be stored to or retracted from the rear side of a bucket. The shortcoming of such concepts includes their limited application and failure to address considerations inherent in more useful handling apparatus.

Thus a need remains for storable handling devices that expand the functions of a material handling apparatus without interfering with the operator's view or the normal operation of a bucket.

SUMMARY OF INVENTION

It is, therefore, an objective of the present invention to provide an improvement to a material handling apparatus comprising storable and retractable grappling devices which extend the range and function of such material handling apparatus, without unnecessarily interfering with the normal operation thereof.

Another object of the present invention is to provide an improvement to a material handling apparatus which alleviates potential damage to grappling devices.

Yet another object of the present invention is to provide an improved material handling apparatus, which includes a grappling device having retractable fingers for expanding the use of material handling apparatus and means for storing such fingers behind the material handling apparatus.

It is yet another object of the present invention to provide a material handling apparatus with improved hydraulic controls for operating a grappling device.

Another object of the present invention is to provide a modular improvement which may be attached to a material handling apparatus and extend the functional ability thereof.

Thus to achieve these objects, there is provided in one aspect of the present invention an improvement to a material handling apparatus which includes a grappling means having retractable and storable arms which compliment the normal operation of a loader bucket. More particularly, in one embodiment of the present invention there is provided at least one arm member and one or more finger members. The arm member is pivotally attached to at least a finger member and the material handling apparatus. Means for rotating the arm member forwardly to an operative position and rearwardly to a storage position and means for rotating the finger rearwardly to an operative position and forwardly to a storage position are provided.

For the purpose of the present invention, rearwardly shall mean in the direction generally opposite the opening of the bucket of a material handling apparatus and forwardly shall mean the direction generally towards the opening of the bucket of a material handling apparatus.

In a particularly preferred embodiment, the means for rotating the arm member comprises a single hydraulic cylinder which interacts with existing controls.

In the preferred embodiment, the means for rotating the fingers rearwardly and forwardly may comprise a biasing means and a push rod. Further preferred, the biasing means is selected such that abnormal forces cause the fingers to rotate and obviate potential damage to the grappling device. Even further preferred, the push rod comprises a first member pivotally attached to the material handling apparatus and a second member pivotally attached to both the first member and fingers.

Other objects, features and advantages of the present invention will become apparent from a review of the detailed description of the preferred embodiments, including the illustrative drawings and the appended claims which follow.

DETAILED DESCRIPTION OF THE INVENTION

Figure 1:
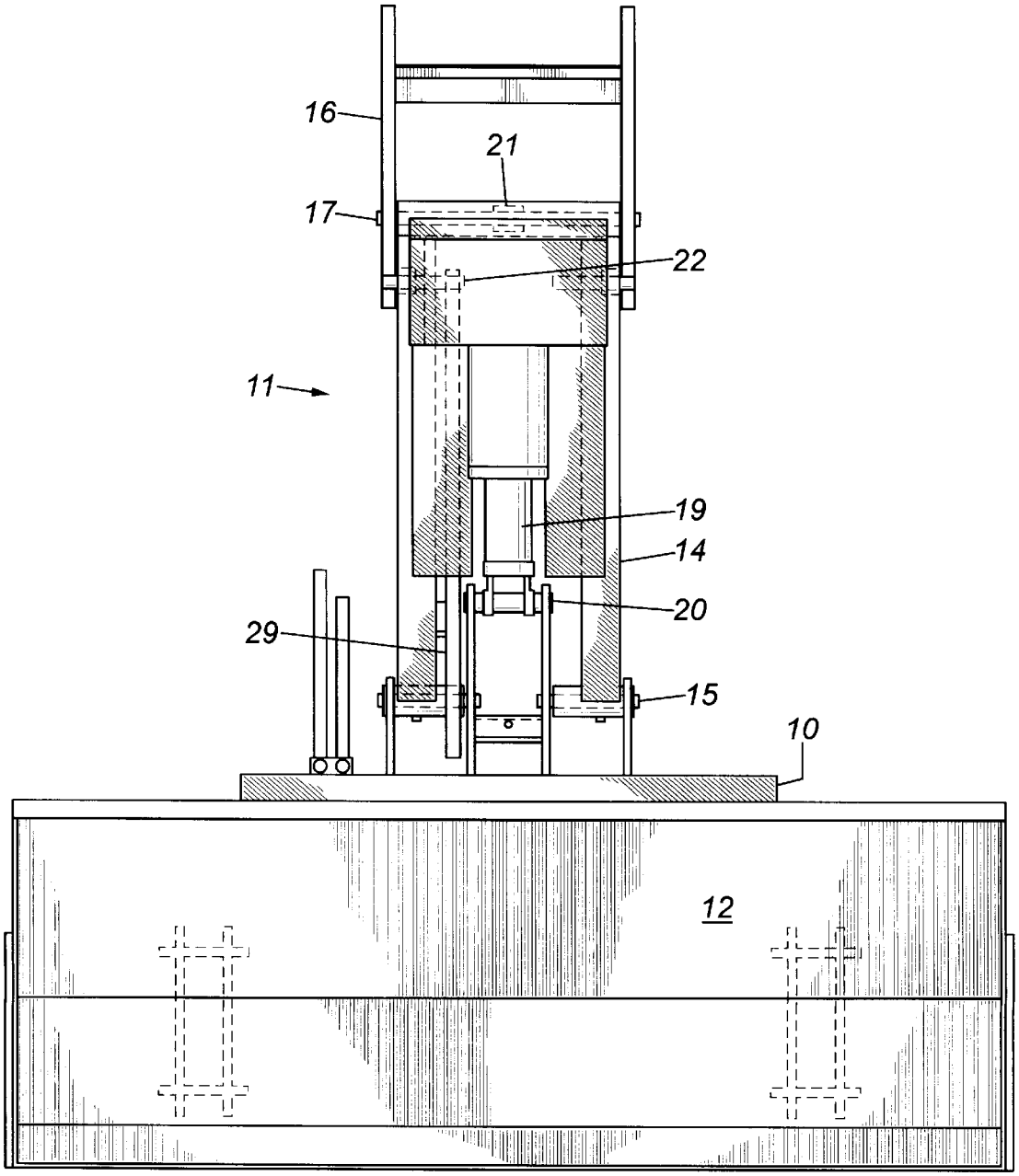
FIG. 1 is a front view of a material handling apparatus embodying the grappling device of the present invention.

The present invention provides an improved grappling device, which may be readily incorporated with a material handling apparatus. In contrast with known apparatus and improvements, the present invention expands the usefulness of a material handling apparatus without unnecessarily interfering with either an operator's vision or the normal operation of a bucket-loader.

As discussed above, bucket loaders are used in a variety of different applications. The usefulness of bucket loaders is somewhat limited because such bucket loaders cannot easily handle awkward loads, large pieces of brush, bales of hay and the like. Prior attempts to address these limitations have unnecessarily limited the normal operation of the front-end loader or failed to significantly expand the range of such apparatus.

For example, a popular improvement incorporates a grappling device on a bucket. While such an improvement aids in the handling of awkward loads, the grappling arms unnecessarily obstruct an operator's view and are easily subject to damage when in a non-use position. The present invention incorporates the advantages of a grappling arm with a front end loader and provides means to store the grappling arms when not in use. Thus, when stored behind the bucket, the grappling arms do not unduly interfere with an operator's line of sight and potential damage to the grappling arms is obviated.

Referring now to FIGS. 1–4 of the drawings, the instant invention maybe better understood. The improved grappling device shown generally by reference numeral 11, is shown in use on any suitable bucket such as bucket 12.

Bucket 12 is attached to a hydraulic cylinder and piston assembly 26 and pivot pin 13 in a matter well known in the art for connection to a vehicle (not shown). Grappling device 11 comprises at least one arm member 14, having a first end which is pivotally connected to the bucket 12 at point 15. One or more finger members 16 are pivotally connected to a second end of arm member 14 at point 17. A first end of hydraulic piston and cylinder assembly 19 is pivotally connected to bucket 12 at point 20 and a second end of hydraulic piston and cylinder assembly 19 is pivotally connected to arm member 14 at point 21.

Selection and alignment of points 15, 17, 20 and 21 are of importance and provide certain advantages. The distance between point 15 and point 21 controls what portion of a three hundred and sixty degree arc the grappling device 11 is permitted to travel through. Preferably, point 15 is first selected to be of sufficient height above a base 10 so as to allow arm member 14 to rotate throughout its working and storage positions without striking base 10. Point 15 and point 20 are then preferably selected at distances which are in direct proportion to the specific stroke of hydraulic assembly 19, with point 15 being vertically below point 20. Finally, point 17 is then preferably, vertically aligned with points 15 and 20 and point 21 is transversely offset from point 17 to move the arm 14 pass dead center.

Figure 2:
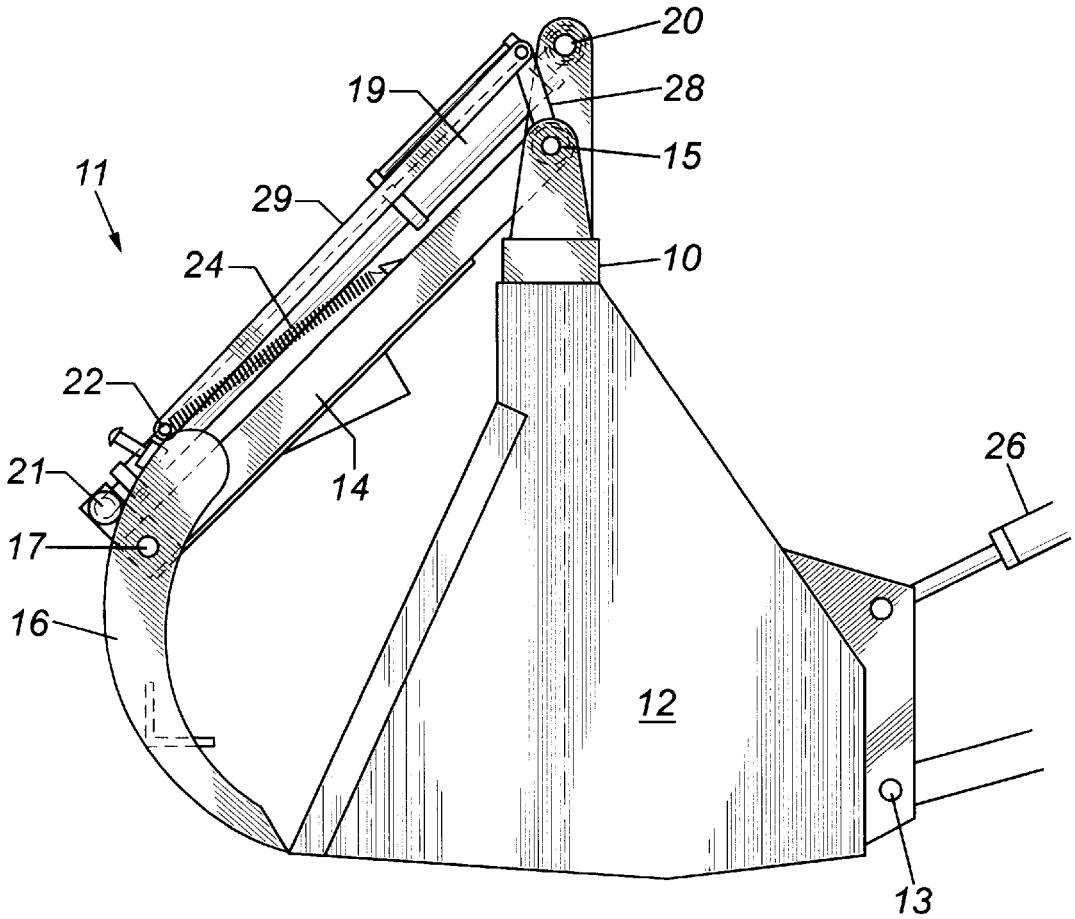
FIG. 2 is a side view of the material handling apparatus of FIG. 1 which shows the improved grappling device in working position.
Figure 3:
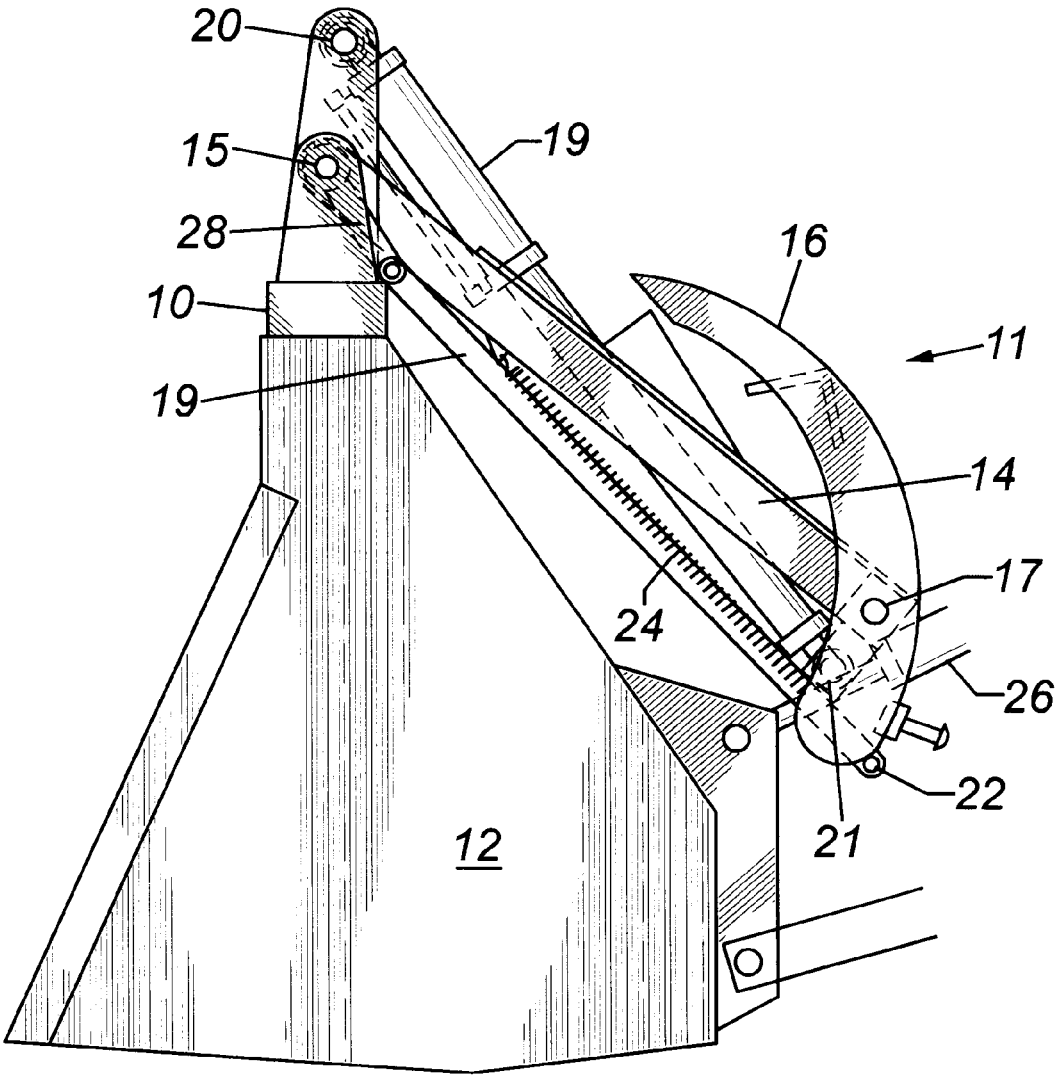
FIG. 3 is a side view of the material handling apparatus of FIG. 1 which shows the handling device in a storage position.

Biasing means 24 is connected to finger 16 and arm member 14 for yieldably urging fingers 16 to a working position (FIG. 2). Push rod 18 is pivotally connected to bucket 12 at point 15 and finger 16 at point 22 for moving the finger 16 to a storage position (FIG. 3).

Figure 4:
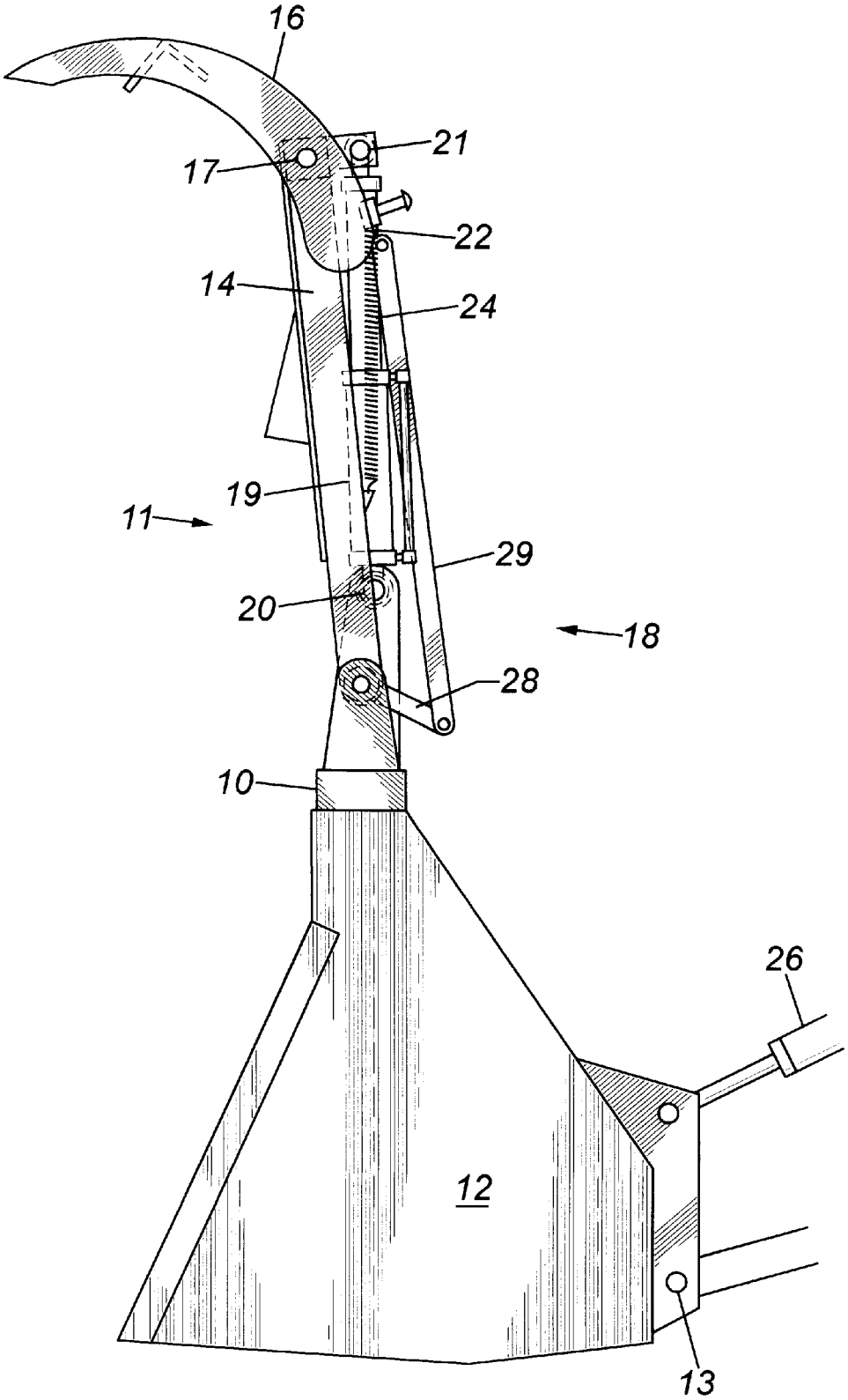
FIG. 4 is a side view of the material handling apparatus of FIG. 1 which shows the improvement in a vertical or intermediate position.

Operation of grappling device 11 is controlled primarily by hydraulic assembly 19. When hydraulic assembly 19 contracts from the working position of FIG. 2, the grappling device 11 is caused to rotate to the vertical position as illustrated in FIG. 4. That is, if the grappling device 11 is in the position as illustrated in FIG. 2, when hydraulic assembly 19 contracts, the device 11 is caused to rotate rearwardly. On the other hand, if the grappling device 11 is in the storage position as illustrated in FIG. 3, when hydraulic assembly 19 contracts the grappling device 11 is caused to rotate forwardly to the vertical position as illustrated in FIG. 4.

Once hydraulic cylinder 19 rotates the grappling device 11 to a vertical position (FIG. 4), a second force is required to shift the grappling device 11 either rearwardly or forwardly off vertical. Preferably, hydraulic assembly 26 is used to shift grappling device 11 off center. By shifting grappling device 11 with hydraulic assembly 26, the need of a third hydraulic assembly is eliminated. When hydraulic assembly 26 contracts bucket 12 is rotated rearwardly, and gravity causes grappling device 11 to rotate rearwardly. When hydraulic assembly 26 extends bucket 12 is rotated forwardly, and gravity cause grappling device 11 to rotate forwardly. Once shifted off vertical, hydraulic cylinder 19 may then extend grappling device 11. That is, if the grappling device is rotated forwardly by hydraulic assembly 26, as hydraulic assembly 19 expands, grappling device 11 is caused to rotate forwardly to an operative position (FIG. 2). If the grappling device is rotated rearwardly by hydraulic assembly 26, as hydraulic assembly 19 expands, grappling device 11 is caused to rotate rearwardly to a storage position (FIG. 3).

Preferably, the rotation of finger 16 is controlled by biasing means 24 and push rod 18. Biasing means 24 urges finger 16 to a normally open position. Suitable biasing means include springs, counter balancing and air pressure. Preferably, biasing means 24 is selected such that, when device 11 is in an operating position (FIG. 2), abnormal external forces applied to the outside of finger 16 cause finger 16 to rotate, and thus minimize the potential of damage. For example, spring 24 provides adequate biasing and allows abnormal forces to cause finger 16 to rotate rather than suffer damage.

As grappling device 11 rotates rearwardly, arm member 28 contacts base 10. As grappling device 11 continues to rotate rearwardly, the effective length of push rod 18, with reference to arm member 14, is increased. As the effective length of push rod 18 is increased, push rod 18 forces finger 16 forwardly. As grappling device 11 is rotated from a storage position as illustrated in FIG. 3, the effective length of push rod 18 is reduced and biasing means 24 urges finger 16 to rotate rearwardly to an operative position.

The present invention, therefore, is well adapted to carrying out the objects and obtain the ends and advantages mentioned, as well as others inherent herein. All presently preferred embodiments of the invention have been given for the purposes of disclosure. Numerous changes in the detail of construction may be made which will readily suggest themselves to those skilled in the art and which are encompassed within the spirit of the invention and the scope of the appended claims.

What is claimed is:

1. A grappling device connectable to a material handling apparatus, comprising:

an arm member having first and second ends, wherein said first end of said arm member is pivotally connectable to said material handling apparatus;

one or more fingers pivotally connected on said second end of said arm member;

a first hydraulic piston and cylinder assembly having first and second ends, wherein said first end of said first hydraulic assembly is pivotally connectable to said material handling apparatus, and said second end of said first hydraulic assembly is connected to said second end of said arm member, whereby actuation of said first hydraulic assembly controls the movement of said arm between a working position and a storage position;

a second hydraulic piston and cylinder assembly having first and second ends, wherein said first end of said second hydraulic assembly is connectable to said material handling apparatus and said second end of said second hydraulic assembly is pivotally connected to said material handling apparatus, whereby actuation of said second hydraulic assembly moves said arm member in a forwardly and rearwardly direction;

a push rod having first and second ends, wherein said first end of said push rod is connectable to said material handling apparatus and said second end of said push rod is pivotally connected to said fingers, whereby when said arm is rotated rearwardly to a storage position, said push rod rotates said fingers into a storage position; and a biasing means attached to said fingers and said arm member for urging said fingers to a normally open position.

2. The grappling device of claim 1, wherein said biasing means is a spring.

3. The grappling device of claim 1, wherein said biasing means allows said fingers to rotate forwardly when subject to abnormal forces.

4. The grappling device of claim 1, wherein said push rod comprises:

a first rod member having first and second ends, wherein said first end of said first rod member is pivotally connectable to said material handling apparatus; and a second rod member having first and second ends, wherein said first end of said second rod member is pivotally connected to said second end of said first rod member and said second end of said second rod member is pivotally connected to said fingers.

5. The grappling device of claim 1, wherein said first end of said first hydraulic assembly is pivotally connectable to said material handling apparatus at a point located above the point where said first end of said arm member is pivotally connectable to said material handling apparatus.

6. The grappling device of claim 1, wherein said first end of said push rod and said first end of said arm member are pivotally connectable to said material handling apparatus at a common point.

7. The grappling device of claim 1, wherein said grappling device comprises a plurality of said arm members and wherein said plurality of arm members are pivotally connectable to said material handling apparatus and each of said plurality of arm members are generally parallel.

8. The grappling device of claim 1, wherein said first end of said arm member is pivotally connectable to said material handling apparatus above said material handling apparatus, whereby said arm member may rotate without striking said material handling apparatus.

9. The grappling device of claim 1, wherein said first end of said first hydraulic cylinder assembly is pivotally connectable to said material handling apparatus vertically above said first end of said arm member.

10. The grappling device of claim 9, wherein the distance between said pivotally connectable first end of said first hydraulic cylinder assembly and said pivotally connectable first end of said arm member is directly proportioned to the specific stroke of said first hydraulic assembly.

11. The grappling device of claim 9, wherein said second end of said first hydraulic cylinder assembly is transversely offset from said second pivotally connected end of said arm member.

12. The grappling device of claim 1, wherein said first end of said push rod is pivotally connected to said first end of said arm member.

* * * * *